United States Patent [19]

Gaglione et al.

[11] 4,434,426

[45] Feb. 28, 1984

[54] PHASED ARRAY ELEMENT WITH POLARIZATION CONTROL

[75] Inventors: Stanley Gaglione, New Hyde Park; James A. O'Hare, Seacliff, both of N.Y.

[73] Assignee: The United States of America as represented by the Secretary of the Army, Washington, D.C.

[21] Appl. No.: 338,702

[22] Filed: Jan. 11, 1982

[51] Int. Cl.[3] ..... H01Q 3/26

[52] U.S. Cl. ..... 343/372; 333/24.3

[58] Field of Search ..... 333/24.3, 24.1; 343/854

[56] References Cited

U.S. PATENT DOCUMENTS

| | | | |
|---|---|---|---|
| 2,974,297 | 3/1961 | Da Ros | 333/24.3 |
| 3,064,214 | 11/1962 | Miller | 333/24.3 X |
| 3,100,287 | 8/1963 | Scharfman et al. | 333/24.1 |
| 3,150,334 | 9/1964 | Petrossian | 333/24.3 |
| 3,706,998 | 12/1972 | Hatcher et al. | 343/854 X |
| 3,938,158 | 2/1976 | Birch et al. | 333/24.3 X |

*Primary Examiner*—Paul L. Gensler

*Attorney, Agent, or Firm*—Robert P. Gibson; Anthony T. Lane; Robert C. Sims

[57] ABSTRACT

The device consist of a latching, nonreciprocal ferrite phase shifter, a latching Faraday rotator, a radiating element and the required matching transformers combined into a single unit used as a phased array element. The phase shift is provided by a toroid type non-reciprocal ferrite phase shifter. The polarization rotation is provided by an axially magnetized ferrite filled waveguide. The impedance matching between the sections is achieved with ceramic transformers. This device provides full polarization control.

1 Claim, 4 Drawing Figures

PHASED ARRAY ELEMENT WITH POLARIZATION CONTROL

DEDICATORY CLAUSE

The invention described herein was made in the course of or under a contract or subcontract thereunder with the Government and may be manufactured, used, and licensed by or for the Government for governmental purposes without the payment to us of any royalties thereon.

DESCRIPTION OF THE BEST MODE AND PREFERRED EMBODIMENT

Figure 1:
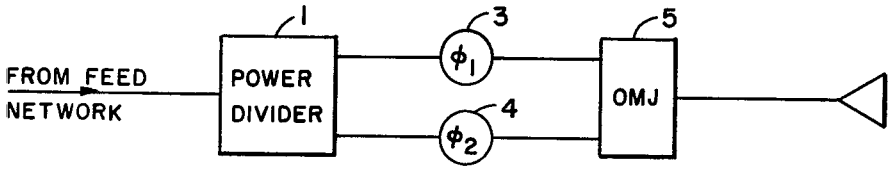
FIG. 1 PRIOR ART
FIG. 1 is a showing of a prior art device.

The present invention is a phase shifter, Faraday rotator, and a radiating element combined into one unit. It is used to control the beam position and the polarization of a phased array antenna. This device can achieve this performance characteristic at a much lower cost than the classical method. The classical method shown in FIG. 1 employs a power divider 1, two beam steering type phase shifters 3 and 4 and an orthogonal mode junction 5 as shown in block form in FIG. 1.

Figure 2:
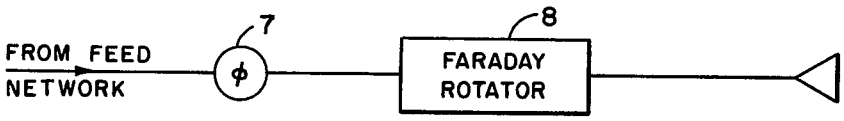
FIG. 2 is a block diagram of the present invention.

The new device is shown schematically in block form by FIG. 2. This device requires only one beam steering type phase shifter 7 and a Faraday rotator 8 realized in ferrite filled waveguide. The Faraday rotator is much less costly than the combination of a power divider, OMJ, and additional beam steering phase shifter. An example of a Ferrite Phase shifter can be found in IEEE transactions on Microwave Theory and Techniques, Volume MTT-18, Number 12, December 1970, pp 1119-1124.

Figure 3:
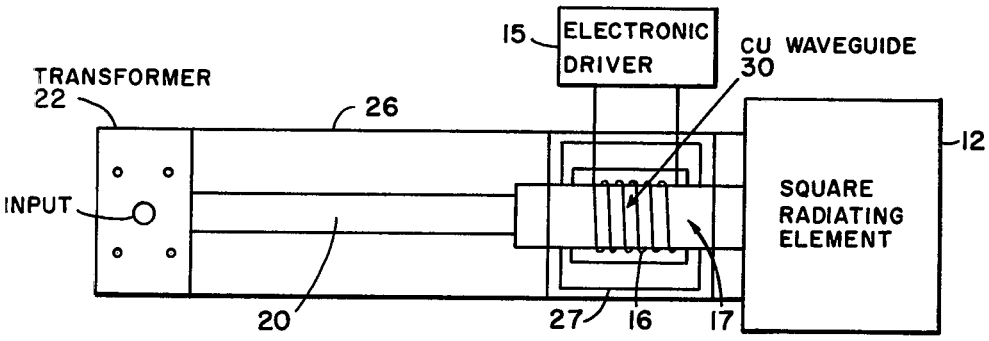
FIG. 3 is a diagrammatic illustration of the present invention.
Figure 4:
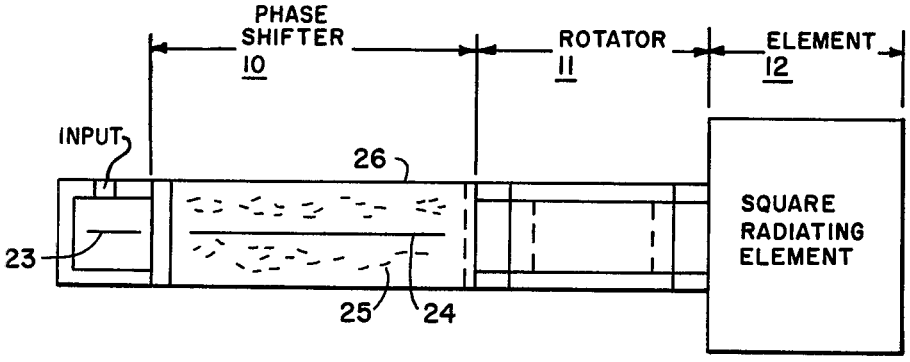
FIG. 4 is a bottom view of FIG. 3.

The present invention is intended to control the polarization of a linearly polarized wave and is not intended to change the type of polarization (linear to circular). FIGS. 3 and 4 show a possible implementation of this device, using a non-reciprocal toroidal type shifter 10 for beam steering, a latching Faraday rotator 11 and a square radiating element 12. The technique can be used with other type phase shifters and radiating elements. Examples of other types of phase shifters are dual mode type and rotary field type. Circular radiating elements can also be used.

The polarization of the output of the Faraday rotator 11 is controlled by the electronic driver 15 which varies the level of remanant magnetization in the rotator ferrite by way of the current pulse in control windings 16. This driver is similar to the type used to control the phase shift of the non-reciprocal phase shifter in the prior art illustrated by FIG. 1. The major difference between the rotator driver and the phase shifter driver is that the rotator driver is required to use the demagnetized state of the ferrite 17 as the polarization reference as opposed to one of the saturated states. The demagnetized state is required as the reference for polarization, because the polarization is relative to the antenna axes and not the adjacent elements. The demagnetized state provides zero rotation which is independent of temperature and magnetic properties of the ferrite. The demagnetized state can be found by at least two methods:

(a) actually demagnetize the rotator ferrite (inside waveguide 30) by applying a damped sinewave type signal. (also called ringing down)

(b) Measure the flux required to change the magnetization from maximum negative to maximum positive and calculate the position of the demagnetized state from this information.

The phase error caused by the rotator as the polarization is varied, is compensated for by the associated beam steering phase shifter toroid 20.

The cost of an antenna system can be further reduced by using a single driver to control groups (subarrays) of rotators. All of the rotators in a group are set to the same polarization in a common driver. The number of drivers required is greatly reduced and the wiring complexity is also reduced.

A Cu waveguide 30 is plated directly on the ferrite for transmission of the signal. The ceramic transformer 22 is provided for coupling the input to the phase shifter. Mode suppressors 23 and 24 are provided. A suppressor support 25 is contained in the housing 26. The rotator 11 is provided with switching yoke 27. The system provides an output to one of the phase array elements in the system.

Advantages of the phase shifter, rotator, element are:

(a) Low cost as compared to two phase shifter method.

(b) Light weight as compared to two phase shifter method.

(c) Simplified packaging and cooling as compared to two phase shifter method.

(d) Simplified driver cabinets and wiring.

(e) Allows full control (±90°) or partial control of polarization with same basic design.

We claim:

1. A radiating system having a polarization rotator comprising a waveguide with an input and an output; ferrite material inside a portion of said waveguide; control windings wound around said portion of said waveguide; an electronic driver unit connected to said control windings so as to initially drive the actual magnetic state of the ferrite material to a demagnetized state so as to act as a reference state; said unit then supplying said control windings so as to drive the magnetization of said ferrite material from said reference state to a predetermined magnetization amount; a ceramic transformer; a lineal polarized signal being fed to the input of said waveguide by way of said ceramic transformer; a mode suppressor provided in said transformer; said polarized signal being rotated in accordance with the magnetic state of said ferrite material and presented at the output of said waveguide; a phase shifter connected between the ceramic transformer and the input of said waveguide; a switching yoke positioned about said ferrite material; and a square radiating element connected to the output of said waveguide.

* * * * *